United States Patent [19]

Totino et al.

[11] 4,372,237

[45] Feb. 8, 1983

[54] TWO DIMENSIONAL FEED FOR MONOGRAM SEWING MACHINE

[75] Inventors: Peter J. Totino, North Bergen; Donald R. Davidson, Berkeley Heights, both of N.J.

[73] Assignee: The Singer Company, Stamford, Conn.

[21] Appl. No.: 334,194

[22] Filed: Dec. 24, 1981

[51] Int. Cl.[3] ..... D05B 27/06; D05B 27/20

[52] U.S. Cl. ..... 112/308; 112/103; 112/119; 112/237; 112/321

[58] Field of Search ..... 112/308, 309, 221, 237, 112/103, 119, 321, 158 R, 158 E

[56] References Cited

U.S. PATENT DOCUMENTS

| | | | |
|---|---|---|---|
| 378,383 | 2/1888 | Von Pittler | 112/103 |
| 384,198 | 6/1888 | Frankenberg | 112/103 |
| 435,062 | 8/1890 | House | 112/103 |
| 983,182 | 1/1911 | Touchstone | 112/119 |
| 2,806,440 | 9/1957 | Schenkengel | 112/103 |
| 3,040,682 | 6/1962 | Leslie | 112/221 |
| 3,561,382 | 2/1971 | Ketterer et al. | 112/321 |
| 4,135,462 | 1/1979 | Brown | 112/158 E |
| 4,184,441 | 1/1980 | Brown et al. | 112/158 E |

*Primary Examiner*—H. Hampton Hunter

*Attorney, Agent, or Firm*—David L. Davis; Robert E. Smith; Edward L. Bell

[57] ABSTRACT

A monogram sewing system comprising a monogram sewing machine capable of needle feeding as well as underbed feed dog feeding of the work piece, an articulated presser foot, and a work holding frame for constraining feeding motion of the work piece to translatory motion.

5 Claims, 3 Drawing Figures

TWO DIMENSIONAL FEED FOR MONOGRAM SEWING MACHINE

DESCRIPTION

BACKGROUND OF THE INVENTION

This invention relates to sewing machines for sewing monograms, or the like, and more particularly to such sewing machines having the capability of automatically feeding the work piece in the lateral, or transverse direction as well as in the longitudinal direction. Such sewing machines are well known in the art. See, for example, U.S. Pat. No. 4,135,462, issued Jan. 23, 1979 to Brown the teachings of which are hereby incorporated by reference. Such sewing machines utilize a presser foot which exerts a very light pressure on the work piece in an effort to compromise between, on the one hand, the need for sufficient pressure to enable feeding in the longitudinal direction and, on the other hand, the need for little or no pressure while feeding in the transverse direction. Such a compromise is, of course, not ideal and results in reduced performance in both directions of feed. Additionally, the work piece has a tendency to rotate somewhat depending on the characteristics of the individual sewing machine.

It is therefore an object of this invention to provide a work piece feed mechanism for a sewing machine wherein appropriate pressure is exerted on the work piece by the presser foot for feeding in the longitudinal direction and the pressure is removed for feeding in the transverse direction.

It is another object of this invention to provide a work piece feed mechanism for a sewing machine wherein the work piece is constrained from rotation during the sewing operation.

SUMMARY OF THE INVENTION

The foregoing and additional objects are attained in accordance with the principles of this invention by providing a sewing machine having a work supporting surface, a work holding frame, and guide means for guiding the work holding frame in translatory motion with respect to the work supporting surface. A presser means and underbed feeding means is provided, each in simultaneous cooperative engagement with the work piece during selected time periods for feeding the work piece in forward and reverse directions. The presser means is out of cooperative engagement with the work piece for time periods other than the selected time periods. A transverse feeding means is provided that is effective for feeding during time periods other than the selected time periods for feeding the work piece in directions other than forward and reverse directions.

BRIEF DESCRIPTION OF THE DRAWINGS

In order that the invention be more fully understood, it will now be described, by way of example, with reference to the following drawings in which.

DESCRIPTION OF THE PREFERRED EMBODIMENT

Figure 1:
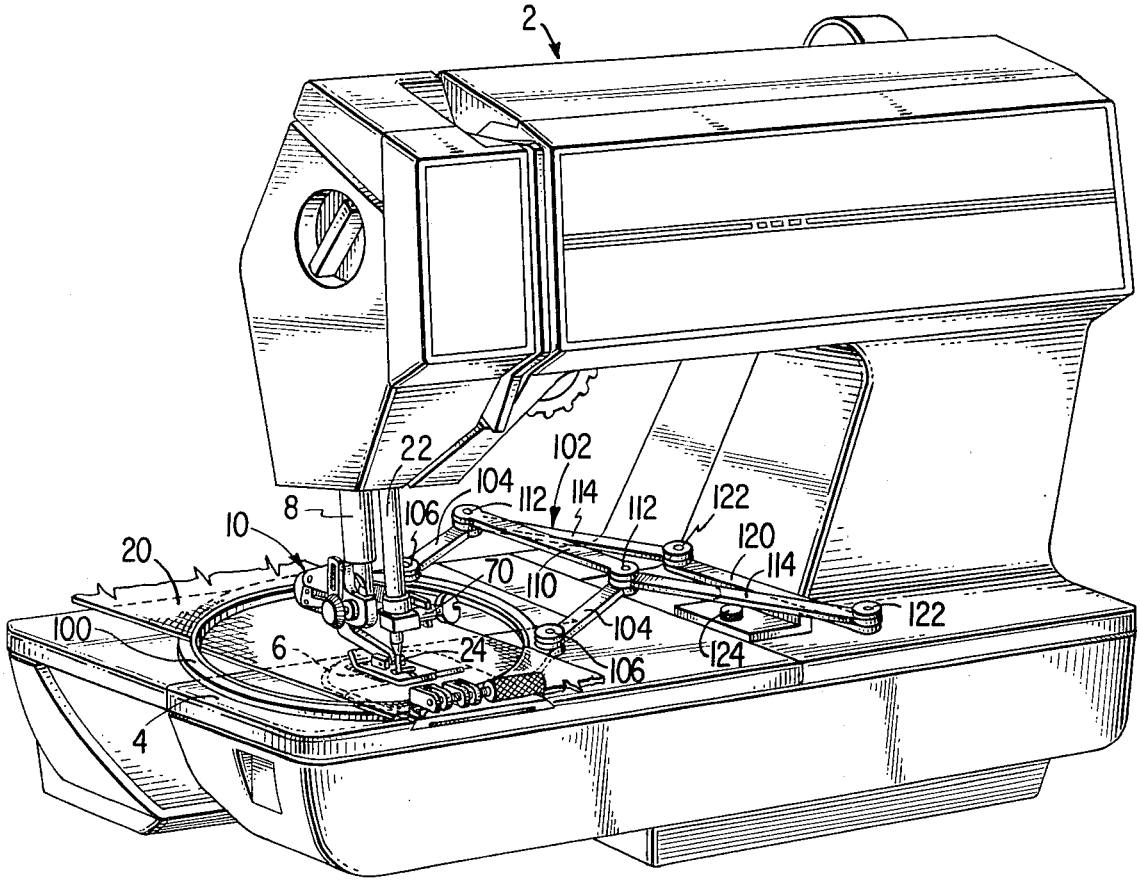
FIG. 1 is a perspective view of a sewing machine illustrating a preferred embodiment of the invention.
Figure 2:
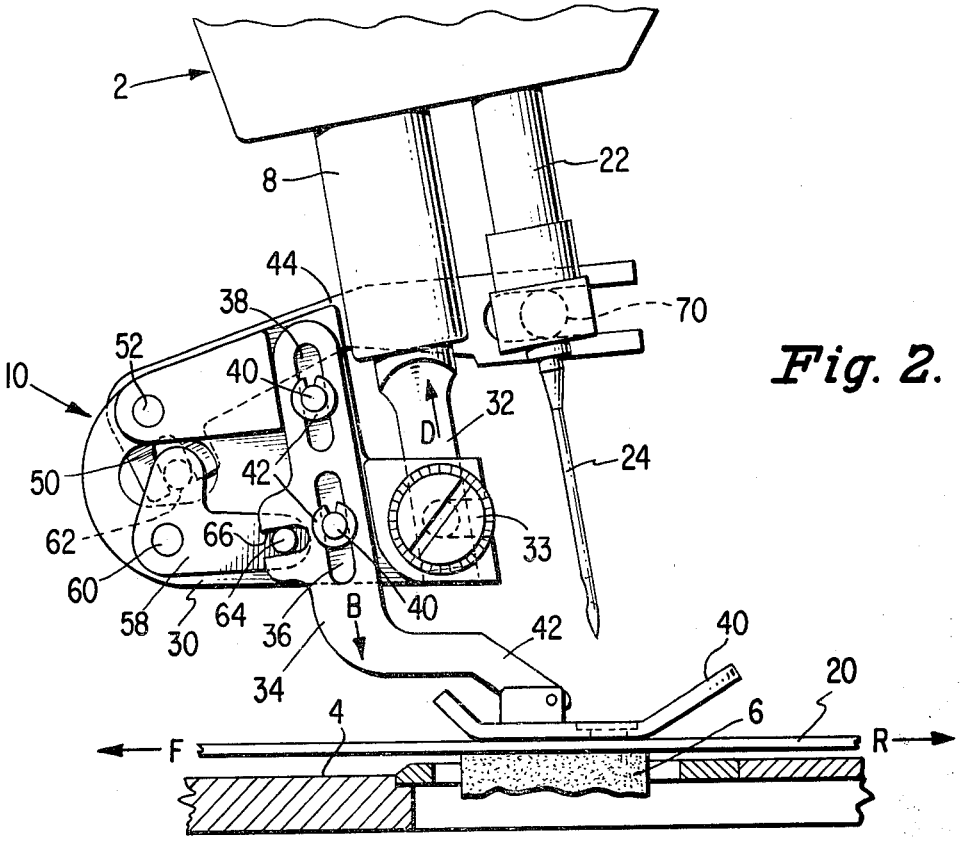
FIG. 2 is a partial end view thereof.
Figure 3:
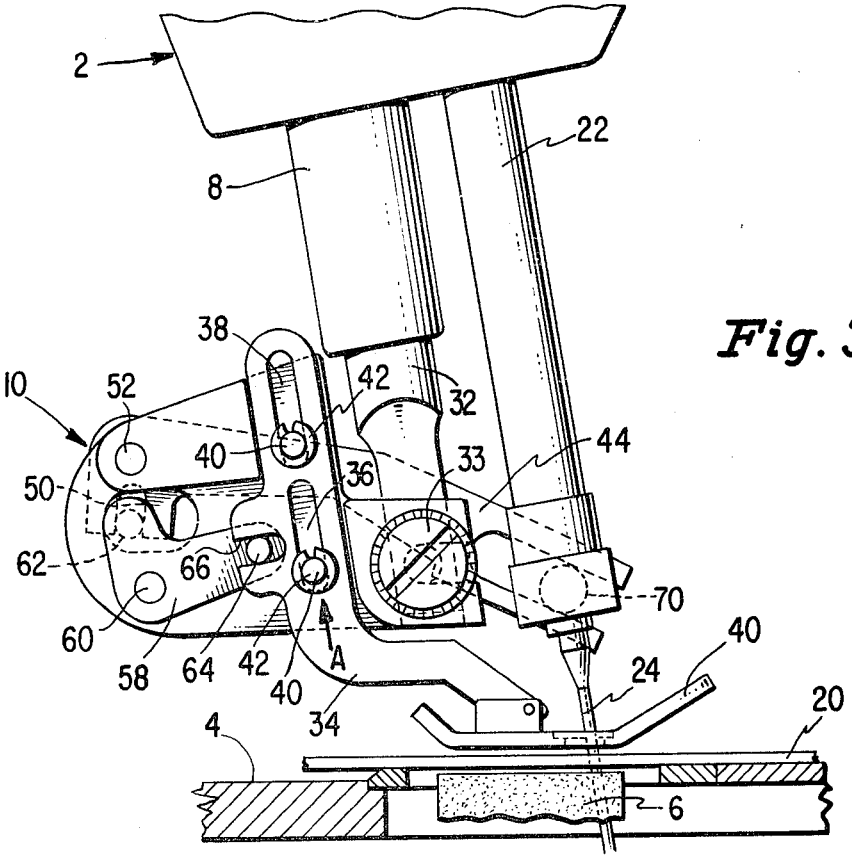
FIG. 3 is similar to FIG. 2.

Referring to FIGS. 1, 2 and 3 there is shown a sewing machine 2 adapted for the sewing of monogram patterns, including a work supporting surface 4, an underbed feed dog 6, a presser bar 8 and presser foot mechanism 10 which cooperates with the feed dog 6 in feeding the work piece 20 in the forward and reverse directions. A needle bar 22 is arranged for endwise reciprocating motion and carries a thread carrying needle 24 for piercing the work piece in the formation of lock stitches. Such mechanisms are well known in the art and will not be described in detail here. The needle bar 22 and associated needle 24 are further capable of partaking of lateral oscillations transverse to the normal forward and reverse directions of feed. These functions are more fully described in U.S. Pat. No. 4,135,462 which was cited above.

Referring to FIGS. 2 and 3, there is shown a preferred embodiment of an articulated presser foot mechanism 10. A bracket 30 is removably attached to the end 32 of the presser bar 8 by a thumb screw 33. A guide member 34 having two elongated holes 36 and 38 formed therethrough is retained in sliding engagement with the bracket 30 by two pins 40, each having a suitable snap retaining ring 42 seated in an annular groove formed therein. The two pins 40 are arranged so that they project through the guide member 34 having the retaining rings 42 on the side of the guide member 34 that is opposite the bracket 30. The elongated holes 36 and 38 are spaced with respect to the pins 40 so that the guide member 34 may undergo a substantially vertical up and down movement as indicated by the arrows A and B of FIGS. 3 and 2, respectively. A presser foot 40 is attached to the free end 42 of the guide member 34 and will move therewith.

An actuating lever 44 is provided having one extremity with an open ended slot 48 formed therein approximately horizontal with respect to the work supporting surface 4, and having the other extremity with an open ended slot 50 formed therein facing downwardly toward the work supporting surface 4. The actuating lever 44 is pivotally attached to the bracket 30 by a suitable pin 52 located near the extremity containing the slot 50. An L shaped bell crank 58 is pivotally attached to the bracket 30 by a suitable pin 60. The bell crank 58 has a follower pin 62 rigidly attached to one extremity which slidingly engages the open ended slot 50, and a driving pin 64, rigidly attached to the other extremity which slidingly engages a slot 66 formed in the guide member 34 normal to the axis of the elongated holes 36 and 38. The open ended slot 48 of the actuating member 44 is arranged to slidingly and pivotally embrace a cylindrical drive member 70 which is rigidly attached to the vertically reciprocating needle bar 22.

Referring to FIG. 1, there is shown a work holding frame 100 having a work piece 20 rigidly clamped therein. The frame 100 is movably attached to the sewing machine through two cooperating pivotal parallelograms indicated at 102. The first parallelogram comprises a pair of idler links 104 of equal length pivotally attached on one end to the work holding frame 100 at the points 106 and at the other end to a common link 110 at the points 112. The second parallelogram comprises another pair of idler links 114 of equal length and having one end pivotally attached to the common link 110 at the points 112 and having the other end pivotally attached to a support bracket 120 at the points 122. The support bracket 120 is rigidly attached to the sewing machine by a suitable fastener 124. This arrangement will permit translatory movement of the work holding frame 100 with respect to the work supporting surface 4 while preventing rotational movement thereof.

In operation, the presser bar 8 is actuated, in a manner well known in the art, thereby lowering the presser foot 4 into feeding engagement with the work piece 20 in cooperation with the feed dog 6. As sewing commences the feed dog 6 advances the work piece 20 in the forward or reverse directions as indicated by the arrows F and R of FIG. 2. This advancing or feeding of the work piece 20 by the feed dog 6 occurs during a specific period of time of each stitch forming cycle of the sewing machine, depending on the particular model and style of sewing machine used. As the needle 24 is made to pierce the work piece 20, during the formation of a stitch, the cylindrical drive member 70 acting on the open ended slot 48 causes the actuating member 44 to pivot about the pin 52 to the position shown in FIG. 3. As the actuating member 44 pivots, the slot 50 acting on the pin 62 causes the bell crank 58 to pivot counterclockwise as viewed in FIG. 3, resulting in the pin 64 acting against the wall of the slot 66 and urging the guide member 34 upwardly in the direction indicated by the arrow A. This action completely disengages the presser foot 40 from the work piece 20. With the needle 24 in the position shown in FIG. 3, the needle bar 22 is jogged to the left or right a desired amount in correspondence to the requirements of the stitch pattern being sewn. This jogging motion imparts a transverse feeding movement to the work piece 20 and is known in the art as needle feeding. The reader is referred to U.S. Pat. No. 4,135,462 for a more detailed description of needle feeding. As the needle bar 22 begins to retract the actuating member 44 begins to pivot counterclockwise about the pin 52, thereby causing the bell crank 58 to pivot clockwise about the pin 60 and urging the guide member 34 downwardly in the direction indicated by the arrow B. This action continuing, the presser foot 40 pressingly engaging the work piece 20 followed by complete needle withdrawal from the work piece 20. This last increment of upward motion of the needle bar 22 causes the presser bar 8 to move upwardly a slight amount in the direction indicated by the arrow D of FIG. 2. This upward motion of the presser bar 8 is counter to a downward biasing force of a presser bar spring, not shown. The feed dog 6 then engages the work piece 20 and, in cooperation with the presser foot 40, advances the work piece 20 in the forward or reverse directions as before. In this manner, the work piece 20 undergoes positive feeding movements in both longitudinal and transverse directions. Since the presser foot 40 has completely disengaged from the work piece 20 after the needle 24 has pierced the work piece, smooth, effective needle feeding may occur without rotational displacement of the work piece. In this way the work piece 20 and work holding frame 100 are propelled in the longitudinal and transverse directions by forces exerted through the work fabric or work piece 20 and derived from stitch-by-stitch work feeding impulses of the sewing machine feed mechanism.

Note that the above disclosed combination of: (1) a sewing machine capable of both needle feed in the transverse direction and underbed feed dog feed in the longitudinal direction; (2) an articulated presser foot; and (3) a work holding frame that constrains motion of the work piece to translatory motion, provides a unique and extremely effective monogram sewing system. With this arrangement the component parts are economical to manufacture and simple to assemble.

Upon reviewing the present disclosure a number of alternative constructions will occur to one skilled in the art. Such constructions may utilize variations in the work holding frame and associated parallelogram type linkages or in the pivoted and sliding members of the presser mechanism. Such constructions however, are considered to be within the spirit and scope of this invention.

We claim:

1. A sewing machine having a work supporting surface, a work holding frame, guide means for constraining said work holding frame in translatory motion with respect to said work supporting surface, presser means and underbed feeding means, means for urging said presser means and said underbed feeding means each into simultaneous cooperative engagement with the work piece during selected time periods for feeding the work piece in forward and reverse directions, means for rendering said urging means ineffective for time periods other than said selected time periods, and transverse feeding means effective during said time periods other than said selected time periods for feeding the work piece in directions other than said forward and reverse directions.

2. A sewing machine having a work supporting surface, a work holding frame for rigidly clamping the work piece while sewing, guide means for constraining said work holding frame in translatory motion with respect to said work supporting surface, and work feeding means for imparting longitudinal and transverse motion to said work holding frame through said work piece rigidly clamped therein during sewing.

3. The combination of claim 2 wherein said work feeding means comprises: (1) a presser means and underbed feed dog each in simultaneous cooperative engagement with the work piece for feeding thereof in forward and reverse directions, and (2) transverse feeding means effective for feeding said work piece in directions transverse to said forward and reverse directions.

4. The combinations of claims 1 or 3 including a vertically reciprocating needle bar having a thread carrying needle attached thereto and arranged to penetrate the work piece in the formation of lock stitches; wherein said presser means comprises:

a. a vertically disposed presser bar one end of which is facing said work supporting surface;

b. a bracket attached to said one end of said presser bar;

c. a presser foot associated with said bracket and arranged to partake of substantially vertical movement with respect to said bracket for engagement with said work piece;

d. an actuating lever associated with said bracket, said presser foot, and said needle bar so that said vertically reciprocating needle bar effects said substantially vertical movement of said presser foot, wherein said presser foot is out of said engagement with said work piece during the period of time of said needle penetration of said work piece.

5. The combination of claim 4 wherein said transverse feeding means comprises said vertically reciprocating needle bar and associated needle partaking of selected movements transverse to said forward and reverse directions of feeding during said period of time of said needle penetration of said work piece.

* * * * *